United States Patent [19]

Crepinsek

[11] Patent Number: 4,573,334

[45] **Date of Patent: * Mar. 4, 1986**

[54] DEADBOLT LOCK ADJUSTABLE FOR MOUNTING IN DOORS OF VARIOUS THICKNESSES

[76] Inventor: Alois Crepinsek, 97 N. Arizona Pl., Chandler, Ariz. 85224

[ * ] Notice: The portion of the term of this patent subsequent to Dec. 25, 2001 has been disclaimed.

[21] Appl. No.: 460,158

[22] Filed: Jan. 24, 1983

[51] Int. Cl.[4] ..... E05B 9/08

[52] U.S. Cl. ..... 70/451; 70/370; 70/452

[58] Field of Search ..... 70/370, 447–451, 70/DIG. 60, 381; 292/357, 350, 354, 355; 248/222.3; 403/348, 349

[56] References Cited

U.S. PATENT DOCUMENTS

| | | | |
|---|---|---|---|
| 549,134 | 11/1895 | Judd | 70/370 |
| 1,461,756 | 7/1923 | Croning | 70/449 X |
| 1,480,650 | 1/1924 | Bacon | 70/370 |
| 2,327,070 | 8/1943 | Schlage | 70/450 X |
| 2,810,600 | 10/1957 | Kendrick | 292/357 |
| 3,621,685 | 11/1971 | Sargent | 70/422 X |
| 3,677,593 | 7/1972 | Wahlberg | 292/357 X |
| 3,815,390 | 6/1974 | Stoia | 70/370 X |
| 3,992,908 | 11/1976 | Crepinsek | 70/451 X |
| 4,272,974 | 6/1981 | Hennessy | 70/451 X |
| 4,424,691 | 1/1984 | Foshee | 70/416 X |
| 4,489,577 | 12/1984 | Crèpinsek | 70/452 |

FOREIGN PATENT DOCUMENTS

| | | | |
|---|---|---|---|
| 628361 | 3/1936 | Fed. Rep. of Germany | 70/452 |
| 995045 | 11/1951 | France | 70/370 |
| 1569984 | 6/1969 | France | 70/448 |

*Primary Examiner*—Robert L. Wolfe
*Assistant Examiner*—Russell W. Illich
*Attorney, Agent, or Firm*—Robert A. Hirschfeld; James F. Duffy

[57] ABSTRACT

A deadbolt lock is adaptable for installation in doors of various thicknesses. The lock body and interior rosette are established at a fixed position with respect to the interior surface of the door in which the lock is mounted. A cylindrical threaded coupler is threaded to an extension of the exterior keyway-carrying rosette of the lock and the coupling between the threaded cylinder and the threaded extension of the rosette are adjusted in accordance with the thickness of the door to which the lock is installed. The interior threaded coupling cylinder is then inserted within the bore of the lock, the mounting being achieved without interference with the deadbolt throw/retract mechanism interior of the lock body. The assembly is secured by compressing the door between interior and exterior decorative plates, the compression resulting by the drawing of the exterior rosette against the outer decorative plates by engaging a retaining nut with threads of the interior coupling cylinder which protrudes through the interior side of the lock body. Both the exterior and interior keyway-carrying rosettes are fastened by means of concealed non-rotatable couplings. The door must be in its opened position before any access may be gained to the interior of the lock. An extremely strong lock mounting arrangement results which inhibits tampering with the lock when the door is closed.

3 Claims, 9 Drawing Figures

DEADBOLT LOCK ADJUSTABLE FOR MOUNTING IN DOORS OF VARIOUS THICKNESSES

CROSS-REFERENCES TO RELATED APPLICATIONS

The concealed coupling of a keyway rosette to a deadbolt lock body forms the subject matter of and is claimed in copending U.S. application Ser. No. 06/448,686, filed Dec. 10, 1982, now U.S. Pat. No. 4,489,577.

BACKGROUND

1. Field of the Invention

The invention relates to the field of door mounted locks.

The invention particularly relates to the improvement in door mounted locks permitting the mounting of such locks in doors of various thicknesses.

The invention relates to door locks capable of mounting in doors of various thicknesses wherein all assembly and mounting hardware is totally concealed and inaccessible when the lock is emplaced within the door and the door is in the closed position.

2. Prior Art

Heretofore, lock cylinders for door locks have been captured within a cylinder housing of the lock assembly by means of one or more machine screws. Typically, one machine screw passes from the inside of the door to the outside half of the lock cylinder housing and a second screw, accessible from the outside of the door, passes from the outside half of the lock cylinder housing into the inside half of the lock cylinder housing.

One of the problems with this type of door lock arrangement is that the outside machine screw can be removed such that the outside lock cylinder is held into the housing only by means of one machine screw inaccessible from the outside but accessible from the inside. This remaining machine screw is easily broken by means of prying or twisting on the exposed outside portion of the lock cylinder housing or may be removed by gaining access to the inside of the door. Thus, the inventor herein, desiring to provide an improved door lock assembly wherein there were no machined screw fasteners accessible either on the inside or the outside of the door and wherein at least one of the lock cylinders was fastened into the lock cylinder housing in such a manner that it could only be released by access to the side edge of the door after the door had been opened with a key, the inventor provided the disclosures set forth in U.S. Pat. Nos. 3,934,437; 3,961,508; and 3,992,908 wherein were disclosed two internally threaded cylinders, each communicating to an outside of the lock body and each of which were coupled together internal of the lock body by means of an externally threaded coupling insert. The interior rosette was spring loaded for cooperating with a rather complicated internal locking structure and a multiplicity of tool wielding operations were required to properly adjust and install the lock in position on a door. The lock disclosed did have the advantage that it would be adjustable to doors of various thicknesses and could be disassembled readily only when the door was in its open position.

It is an objective of the present invention to avoid the complications and disadvantages of the prior art.

It is a further objective of the invention to provide a door mounted lock which is adjustable to doors of various thicknesses and in which the means for disassembling the lock from the door are totally concealed and are inaccessible except when the door is in its open position.

It is a further objective of the invention that the lock may neither be assembled nor disassembled except that the deadbolt throw/retract mechanism be in a preselected position and that assembly or disassembly shall be inhibited when the deadbolt is fully thrown or fully retracted.

It is a further objective of the invention that both the interior and exterior rosette shall have means coupled thereto for concealingly and positively inhibiting rotation of said rosettes when they are coupled to the door lock and mounted in a door.

SUMMARY OF THE INVENTION

The invention provides an improvement in the existing combination of a dead lock of the type which is mounted in a door and having a lock body with a bore therethrough which provides access to the deadbolt throw/retract mechanism. The deadbolt lock also comprises a first raised element means, or rosette, non-adjustably coupled to the lock body and carrying a keyway therein for providing secure access to the deadbolt throw/retract mechanism. Also coupled to the lock body is a second rosette keyway-carrying element. The improvement makes the deadbolt lock adaptable for mounting in doors of various thicknesses and comprises coupling means non-adjustably and non-rotatingly mounted within the bore of the lock body and extending a first preselected distance beyond an outer boundary of that bore. Also provided are means for adjustably coupling the second keyway-carrying rosette to the coupling means first mentioned above at a second preselected distance beyond the outer boundary of the bore. The adjustable coupling means is inaccessible when the deadbolt lock is mounted in a door and the door is in its closed position. The non-adjustabe coupling means mounted within the bore comprises a screw threaded cylinder for coupling to the adjustable coupling means. That adjustable coupling means comprises a cylindrical extension of the second keyway-carrying rosette. This cylindrical extension is screw threaded for adjustably mating with the screw threads of the non-adjustable coupling means.

The cylindrical screw threaded coupling means, non-adjustaby mounted within the lock body bore, further comprises means for mounting this non-adjustable coupling means within the bore without interference with the deadbolt throw/retract mechanism. This mounting means permits the non-adjustable coupling means to be mounted within the lock body bore only when the deadbolt throw/retract mechanism is in a preselected position. The non-adjustable coupling means is further provided with means for permitting the free operation of the deadbolt throw/retract mechanism while that coupling means is so mounted within the bore of the lock.

The second keyway-carrying rosette further comprises means for inhibiting the rotation thereof and thus inhibiting adjustment of its threaded coupling to the non-adjustable coupling means. This means for inhibiting the rotation of the second keyway-carrying rosette is concealed when the deadbolt lock is mounted to a door.

Cover plate means are coupled to the lock body and the second keyway-carrying rosette is non-rotatably coupled, in a concealed manner, to said cover plate means.

Slide latching recess means are coupled to the lock body and the first keyway-carrying rosette is provided with latch pin means affixed thereto for concealed locking engagement to the slide latching recess means upon a preselected movement of the first rosette.

Means are provided for inhibiting disengagement of a first one of said latch pin means from a first one of said slide latching recess means. There are also provided means which couple a second one of the latch pin means to a first one of the latch pin means so as to inhibit rotation of the second one about the first one. This coupling of the first and second latch pin means one to another also inhibits disengagement of the second one of the latch pin means from a second one of said slide latching recess means.

To inhibit disengagement of a first one of the latch pin means from a first one of the slide latching recess means, there is provided means for inhibiting translation of said first one of the latch pin means within said first one of said slide latching recess means. This translation inhibiting means comprises further means coupled to that first one of the slide latching recess means so as to block the recess of that slide latching recess means and thereby inhibit slide motion of said latch pin means therein. The first and second latch pin means are coupled one to another by means of an annular segment which is slidingly coupled to the lock body.

DETAILS OF THE INVENTION

Figure 1:
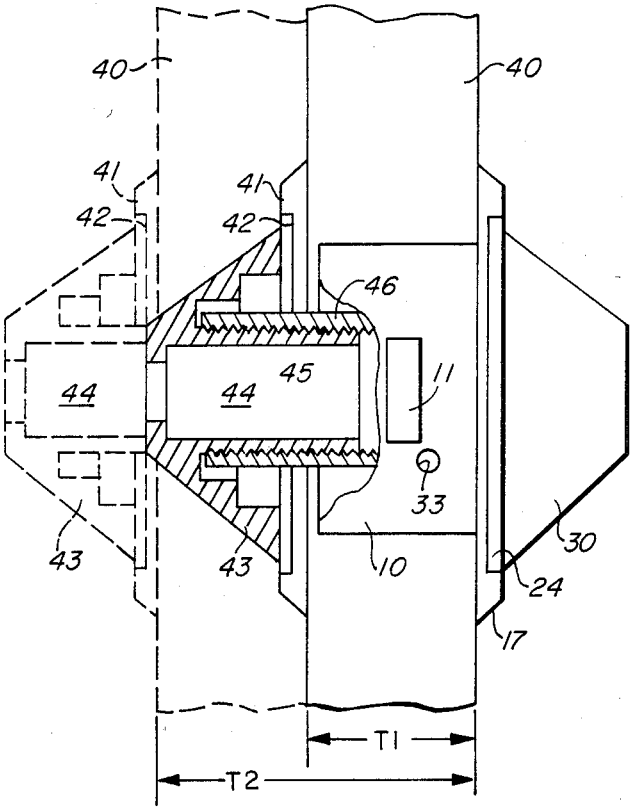
FIG. 1 illustrates the manner in which the deadbolt lock is mounted to a door and shows in cross-section detail the means whereby the lock is adjusted to fit doors of various thicknesses, a phantom outline illustrating the exterior rosette displaced for mounting in a door of greater thickness than that illustrated by the solid outlines.

For the purposes of promoting an understanding of the principles of the invention, reference will now be made to the embodiments illustrated in the drawings and specific language will be used to describe the same. It will, nevertheless, be understood that no limitation of the scope of the invention is thereby intended, such alterations and further modifications in the illustrated device, and such further applications of the principles of the invention as illustrated therein being contemplated as would normally occur to one skilled in the art to which the invention relates.

In FIG. 1, lock body 10 is illustrated mounted in a door 40. The solid outlines of door 40 are indicative of a door having a thickness T1. Also illustrated in FIG. 1, in phantom outline, is a door 40 having a thickness T2. Lock body 10 is shown mounted in door 40 with a door protection plate 17, cover plate 24 and interior rosette 30 mounted flush to the interior surface of door 40. Rosette 30 is a decorative, raised element, keyway-carrying means. Lock body 10 houses a deadbolt 11 and deadbolt throw/retract mechanism, not shown. A door protection plate 41, cover plate 42 and exterior keyway-carrying rosette 43 are mounted flush with the exterior surface of door 40.

An internally threaded cylinder 46 is non-adjustably mounted to and within lock body 10 to provide the means for coupling to the externally threaded cylindrical extension 45 of rosette 43. Prior to assembly of coupling elements 46 and 45 to lock body 10, coupling element 45 is threaded into coupling element 46 to an extent just sufficient to accommodate the thickness T of the particular door 40 to which the lock is to be mounted. The externally threaded cylindrical coupling section 45 is provided with a bore 44 to provide key cylinder access to the deadbolt throw/retract mechanism, not shown. Similarly, internally threaded cylindrical coupling mechanism 46 is provided with a bore 13, not referenced in FIG. 1.

Figure 2:
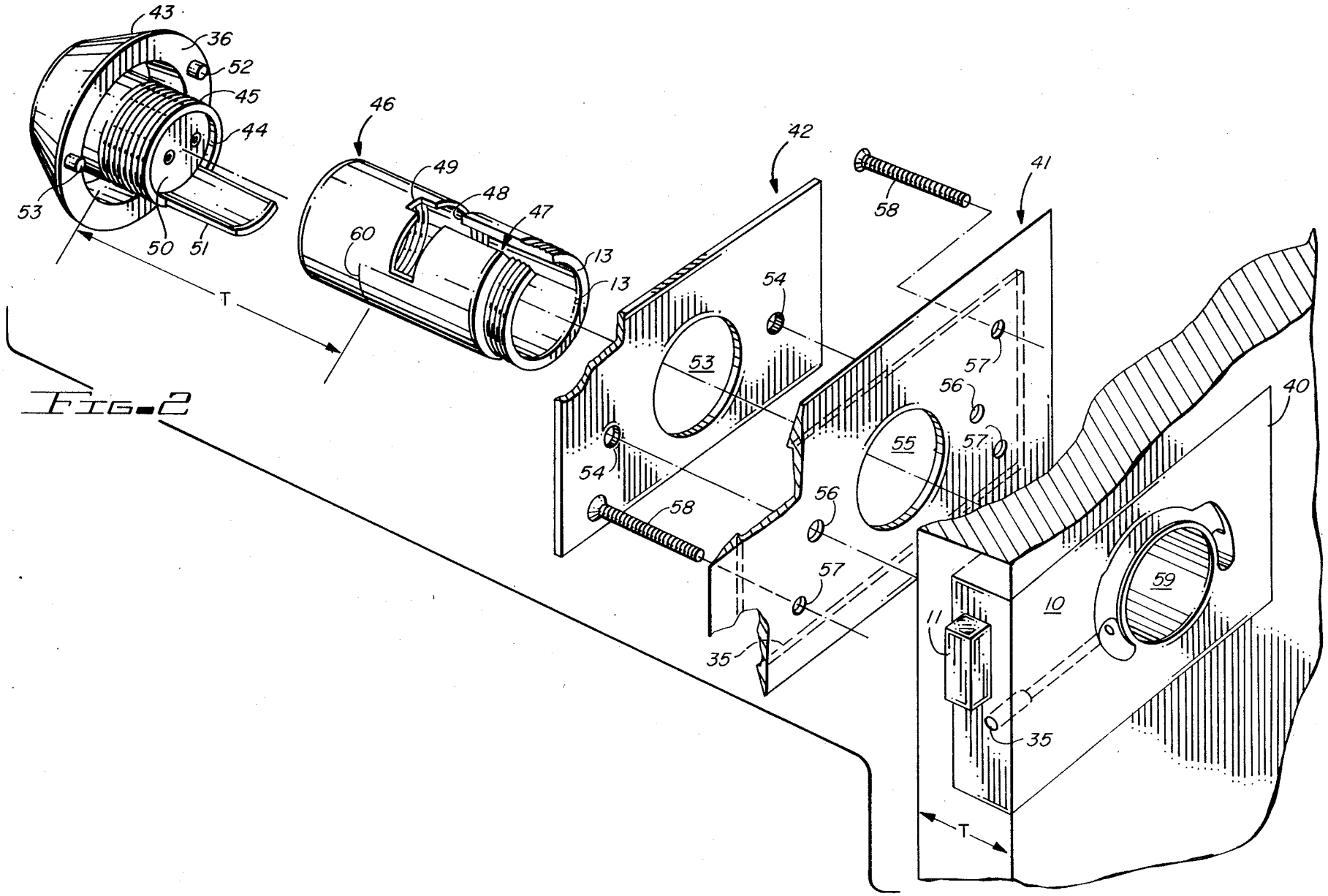
FIG. 2 is an exploded assembly of the elements comprising the means for adjustably coupling the exterior rosette to the door mounted lock body.

In the exploded assembly drawing of FIG. 2, exterior rosette 43 is seen to house lock cylinder 50. Lock cylinder 50 may be pinned within the bore 44 of exteriorly threaded coupling cylinder 45 in a manner well known to those skilled in the art. Lock cylinder 50 is provided with an extended tongue 51 which is rotatably operated by insertion of a key within the keyway, not shown, housed within rosette 43. Rotation of tongue 51 operates the deadbolt throw/retract mechanism, not shown, housed within lock body 10 in a conventional manner.

Threaded extension 45 of rosette 43 is mated with the internal threads of coupling cylinder 46. The depth of penetration of threaded cylinder 45 into coupling mechanism 46 is adjusted so that the distance from the interior face 36 of rosette 43 to the scribed mark 60 on the exterior surface of coupling cylinder 46 is established at a measured distance T equivalent to the thickness of the door 40 to which the lock is to be mounted. Once so adjusted, the assembly of rosette 43 and coupling cylinder 46 is inserted into the bore 59 of lock body 10, passing first through clearance holes 53 of cover plate 42 and 55 of door protection plate 41.

The cylindrical coupling cylinder 46 will be non-adjustably and non-rotatably mounted within bore 59 of lock body 10. To permit a non-interfering assembly of coupling cylinder 46 into the bore 59, a cruciform cutout 57 is provided so that cylinder 46 may be mounted within lock body 10 without interfering with the deadbolt throw/retract mechanism housed within body 10. The cross arm 48 of cruciform cutout 47 provides for a free, noninterference operation of the deadbolt throw/-retract mechanism when cylinder 46 has been mounted within lock body 10. It will be shown that the notch 49 comprising part of the cruciform cutout 47 in cylinder 46 will mate with a portion of the deadbolt throw/retract mechanism so as to inhibit rotation of cylinder 46 when it is mounted to lock body 10.

In mounting lock body 10 to door 40, the lock body 10 is emplaced within a morticed cutout in door 40 and door protection plate 41 is positioned on the outer surface of door 40 and coupled to lock body 10 by means of screws 58 which pass through clearance holes 57 in door protection plate 41 and mate with threaded holes, not shown, in lock body 10. A cover plate 42 is then emplaced within the recess 35 of door protection plate 41 to provide a secure covering of the heads of screw fasteners 58. The coupling cylinder 46, assembled to rosette 43 and adjusted for the proper thickness T of door 40, is passed through the bores 53 and 55 of plates 42 and 41, respectively, and into the bore 59 of lock body 10.

Cover plates 42 and 41 are provided with clearance openings 54 and 56, respectively, which accept lock pins 52, affixed to the interior face 36 of rosette 43 to provide concealed means for inhibiting the rotation of rosette 43 when it is assembled to lock body 10 mounted in door 40.

Figure 4:
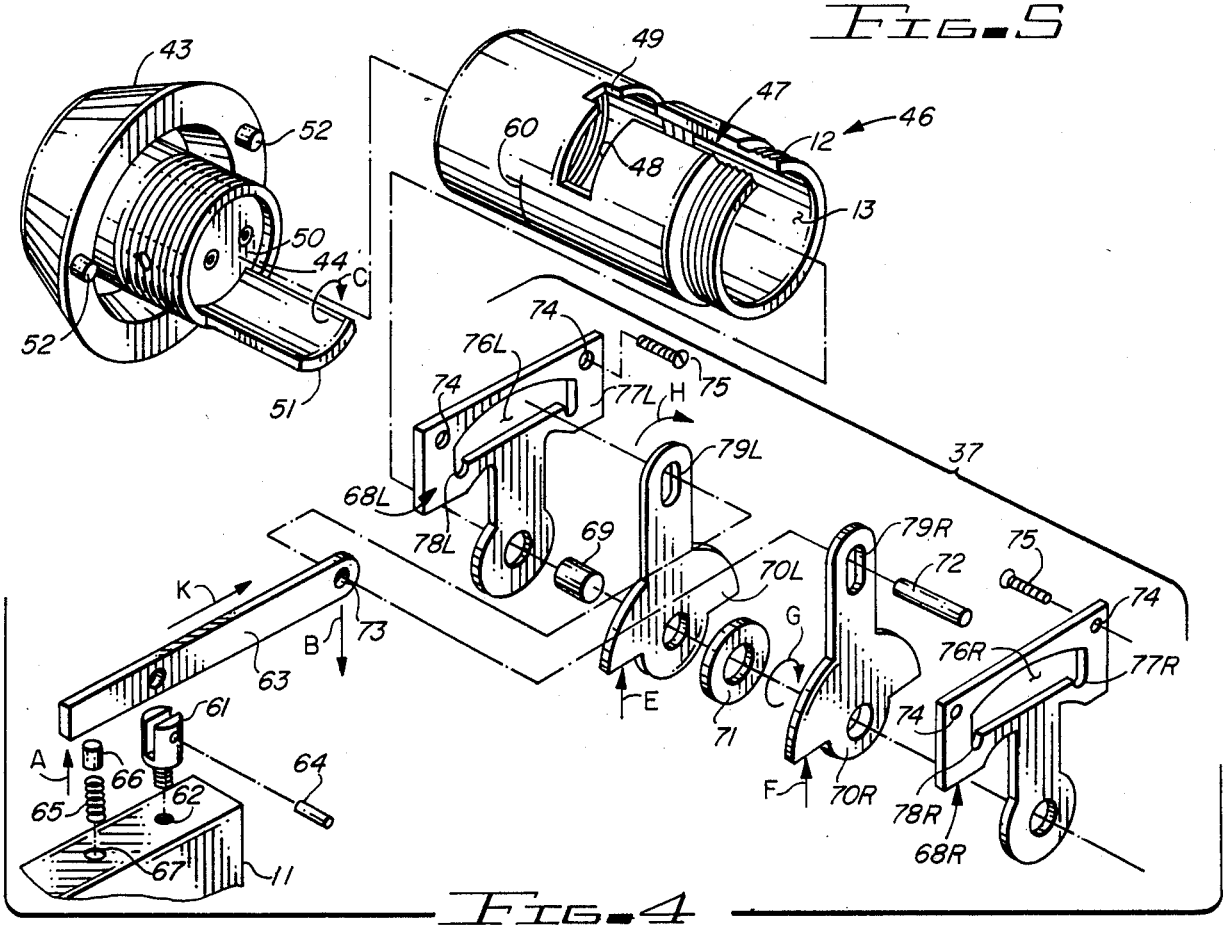
FIG. 4 is an exploded assembly of the deadbolt throw/retract mechanism housed within the lock body (not shown) and the manner in which the door-thickness adjustable coupling mechanism may be incorporated into the lock body on a non-interfering basis with the deadbolt throw/retract mechanism.

To illustrate the manner in which coupling cylinder 46 may be inserted within the bore 59 without interfering with the deadbolt throw/retract mechanism 37, the exploded assembly illustrated in FIG. 4 is provided. Pivot post 61 is thread coupled to threaded hole 62 in deadbolt 11. Deadbolt drive rod 63 is pivot coupled to pivot post 61 by means of pivot rod 64. Spring 65 emplaced within clearance hole 67 of deadbolt 11 exerts an upward force indicated by arrow A on thrust rod 66 which is also emplaced above spring 65 within clearance hole 67. With deadbolt drive rod 63 pivotally coupled to pivot post 61, the upward force, arrow A, is transmitted to the left hand end of deadbolt drive rod 63, as illustrated, to produce a couple about pivot post 64 to produce a downward force, arrow B, at the right hand end of deadbolt drive rod 63, as illustrated.

Drive rod latch plates 68L and R provide the support for axle 69 to which drive linkages 70L and R are rotatably coupled and spaced apart by spacer washer 71.

A coupling shaft 72 affixed to bore 73 of deadbolt drive rod 63 extends to the left and right of deadbolt drive rod 63, as illustrated in the figure, passing through clearance slots 79L and 79R of drive linkages 70L and R, respectively, with an end of coupling shaft 72 terminating within each of coupling shaft travel windows 76L and R.

The assembly is mounted within lock body 10, not shown, by means, for example, of screw fasteners 75 passed through clearance openings 74 in axle support plates 68L and R to couple with mating threaded holes within lock body 10, not shown.

Assume that a key is inserted into the lock cylinder 50 mounted within rosette 43 and operated so as to move tongue 51 in the manner indicated by rotary arrow C. In so rotating, tongue 51 will come into contact with drive linkages 70L and R, exerting upward forces indicated by arrows E and F, respectively. The result of the application of forces E and F will cause drive linkages 70L and R to rotate about axle 69 in the direction indicated by the arrow H. Since coupling shaft 72 passes through slots 79L and R, as drive linkages 70L and R are so rotated, deadbolt drive rod 63, affixed to coupling shaft 72, will be driven in the direction indicated by the arrow K causing deadbolt 11 to retract toward the right of the illustration. In so moving, the ends of coupling shaft 72, moving within travel windows 76L and R, will be forced to terminate within locking notches 77L and 77R by the downward force B exerted on deadbolt drive rod 63 resulting from the action of spring 65. This will affectively latch deadbolt 11 in the retracted position.

Reversing the action of the key within cylinder 50 causes deadbolt 11 to be thrown outward from lock body 10 and results in coupling shaft 72 having its ends positioned within locking notches 78L and 78R of travel windows 76L and R, respectively. This effectively latches deadbolt 11 into the thrown position, extending from lock body 10.

Coupling shaft 72 is unlatched from either one of locking notches 77L and R or 78L and R by the rotary action of drive linkages 70L and R which lift the ends of coupling shaft 72 out of the locking notches and into the travel windows 76L and R.

With the components positioned as indicated in FIG. 4 and rosette 43 coupled to coupling cylinder 46 as required to accommodate a door of thickness T, coupling cylinder 46 will pass into bore 59 of lock body 10 without interferring with deadbolt throw/retract mechanism 37 since free access for coupling cylinder 46 is provided by means of the cruciform cutout 47 in cylinder 46. The rotary action of drive linkages 70L and R is uninhibited because of the free passage provided by the cross arm 48 of cruciform cutout 47 when cylinder 46 is fully emplaced within the bore 59 of lock body 10.

Figure 5:
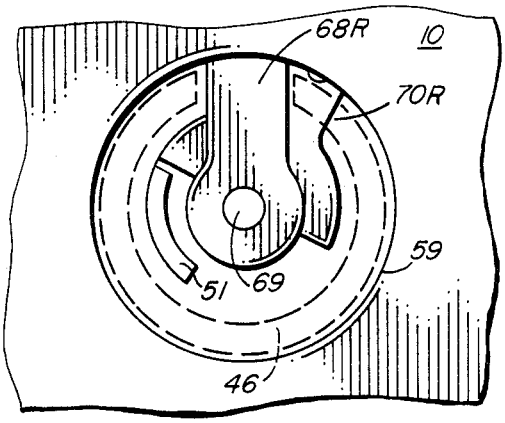
FIG. 5 is an end view of the bore of the lock body illustrating the interference which exists between the deadbolt throw/retract mechanism and the door-thickness adjustable coupling means when the deadbolt throw/retract mechanism is in any but a preselected position thus inhibiting mounting or retraction of that door-thickness adjustable coupling mechanism.

The illustration of FIG. 5 is taken looking into the bore 59 of lock body 10 wherein the deadbolt throw/retract mechanism 37 is mounted and coupling cylinder 46 is emplaced. Coupling cylinder 46 is illustrated in phantom outline for clarity of illustration. Here the tongue 51 of lock cylinder 50 has been rotated in the direction illustrated by rotary arrow C in FIG. 4. This has caused drive linkage 70R (and 70L as well) to move in the direction indicated by rotary arrow H of FIG. 4. It is noted that with drive linkage 70L and R so offset within the cross arm 48 of cruciform cutout 47, an interference will result if it is attempted to insert or remove coupling cylinder 46 from the bore 59 of lock body 10. Thus, deadbolt throw/retract mechanism 37 must have all its component elements in alignment with the cruciform cutout 47 in order that coupling cylinder 46 may be mounted or retracted from lock body 10. In practice, this means that deadbolt 11 must be in a nomimal mid position between fully extracted and fully retracted from lock body 10.

Figure 3:
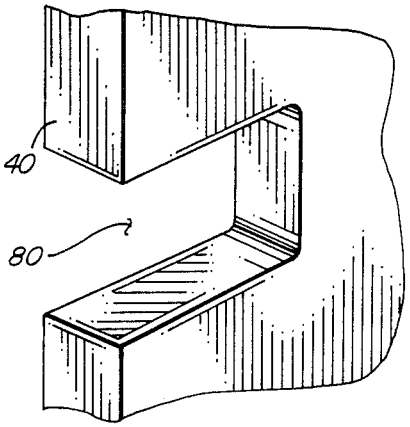
FIG. 3 illustrates that a full cutout of the thickness of the door may be made rather than mortising the door for acceptance of the lock body as is illustrated in FIG. 2.

It should be pointed out that although the illustration of FIG. 2 indicates that lock body 10 is set within a mortised opening in door 40, lock body 10 may be mounted within door 40 by providing a full cutout 80 as indicated in FIG. 3. However, because of the greater strength provided by mortising the cutout, the embodiment illustrated in FIG. 2 is preferred. The ability to provide a full cutout 80 in door 40 results from the fact that the assembly, as will be shown, provides that the door 40 shall be compressed between door protection plates and cover plates mounted to the inner and outer surfaces of door 40. By allowing the edges of these plates to extend generally beyond the limits of cutout 80, a secure mounting of lock body 10 to door 40 may be achieved.

Figure 6:
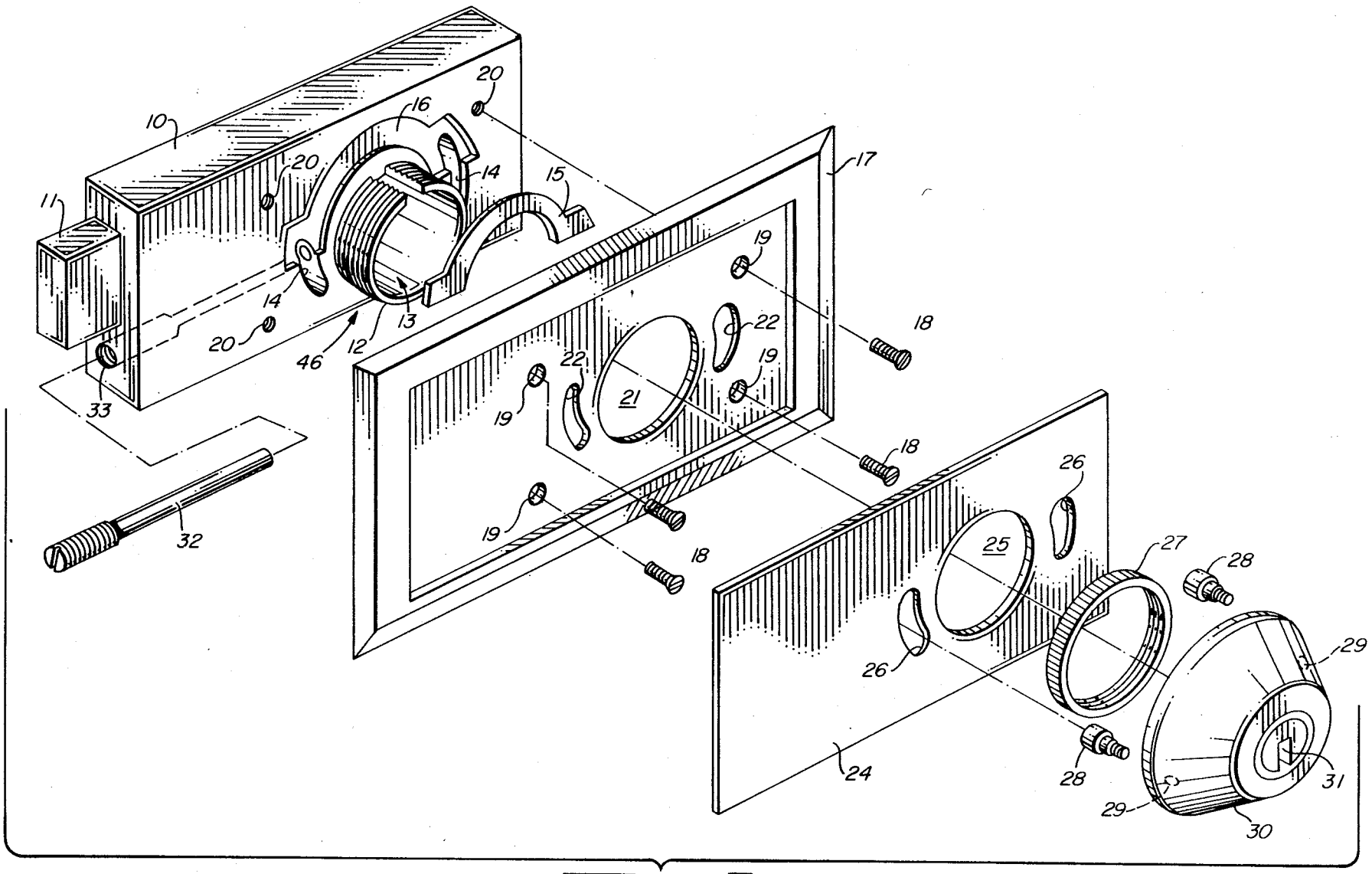
FIG. 6 is an exploded assembly of the elements between the body of the deadbolt lock and the interior rosette including the means whereby the interior rosette is secured to the lock body using positive mechanical stop, interference lock, coupling means.

The exploded assembly is continued with the illustration of FIG. 6 wherein coupling cylinder 46 is shown emplaced within the bore 59 of lock body 10 so that its externally threaded end 12 protrudes from lock body 10. The bore 13 of coupling cylinder 46 provides access to the deadbolt throw/retract mechanism 37 for operation thereby upon insertion of a key within keyway 31 of interior rosette 30. The threaded end 12 of coupling cylinder 46 will provide the means, in combination with retainer nut 27, for securely coupling door protection plate 17 and cover plate 24 to door 40 and to lock body 10. Reference to FIGS. 2, 4 and 5 will show that retainer nut 27 of FIG. 6 may be drawn up snugly along threaded end 12 of cylinder 46 without fear of cylinder 46 rotating since the notch 49 of cruciform cutout 47 will engage in an interfering manner with axle support plate 68L so as to prevent the rotation of coupling cylinder 46 once it is mounted within lock body 10 and that interference further inhibits any lateral adjustment of cylinder 46 within the bore 59 of lock body 10.

Within lock body 10 are two slide latch clearance recesses 14 which will accept in a noninterfering manner latch pins 28 which are threadedly coupled to threaded holes 29 within the raised element, or rosette, 30 which carries keyway 31 and provides secure access thereto.

A recess 16, comprising an annular segment, accommodates slide coupler 15, a segment of similar annular configuration to that of recess 16, which is slidingly coupled to lock body 10 within recess 16. Slide coupler 15 will be employed to couple latch pins 28, one to the other, when the latch pins 28 are inserted within slide latch clearance recesses 14 of lock body 10.

With lock body 10 mounted in door 40, door protection plate 17 is coupled to lock body 10 by passing the clearance hole 21 of plate 17 over the threaded end 12 of coupling cylinder 46. At this time, clearance holes 19 in plate 17 will be aligned with tapped holes 20 in lock body 10. Screw fasteners 18 are passed through clearance holes 19 and threadedly engaged within tapped holes 20 so as to securely affix door protection plate 17 to lock body 10.

When this is done, slide latch recesses 22 in plate 17 will be aligned with slide latch clearance recesses 14 in lock body 10. Slide latch recesses 22 are tapered such that when latch pins 28, coupled to rosette 30, are inserted within slide latch recesses 22 and the rosette 30 rotated, a locking engagement results of latch pins 28 with slide latching recess 22.

Door protection plate 17 is provided with a recess 23 which accepts cover plate 24, threaded end 12 of coupling cylinder 46 being passed through clearance hole 25 in the course of the assembly. Retainer ring 27 is then threadedly coupled to threaded end 12 so as to securely affix cover plate 24 into position within the recess 23 of door protection plate 17 while drawing exterior rosette 43 and plates 41 and 42 into compressive contact with the exterior of door 40. Door 40 is thus compressed between plates 41 and 42, exterior of door 40 and plates 17 and 24, interior of door 40.

Cover plate 24 securely covers screw fasteners 18 and adds to the decorative finish of the assembly of door protection plate 17 with the door and lock body 10. (A similar statement can be made with respect to cover plate 42 and door protection plate 41.) With cover plate 24 so positioned, an additional pair of slide latch recesses 26 is emplaced in alignment with slide latching recesses 22 of cover plate 17. As with slide latching recesses 22, recesses 26 are also tapered to provide for locking engagement with latch pins 28.

In a manner to be more fully disclosed hereinafter, rosette 30, with latch pins 28 coupled thereto, is affixed to the assembly by inserting latch pins 28 through latch recesses 26 and 22 and into clearance recesses 14 and rotating the rosette 30 so as to bring latch pins 28 into locking engagement within the tapered recesses 22 and 26. A locking pin 32 is then threadedly engaged within locking pin receiver 33 of lock body 10 so as to provide a locking interference with one of latch pins 28 so as to prevent its disengagement from within the locking recesses 22 and 26. This will be disclosed in greater detail in the discussion of FIGS. 7–9.

Figure 7:
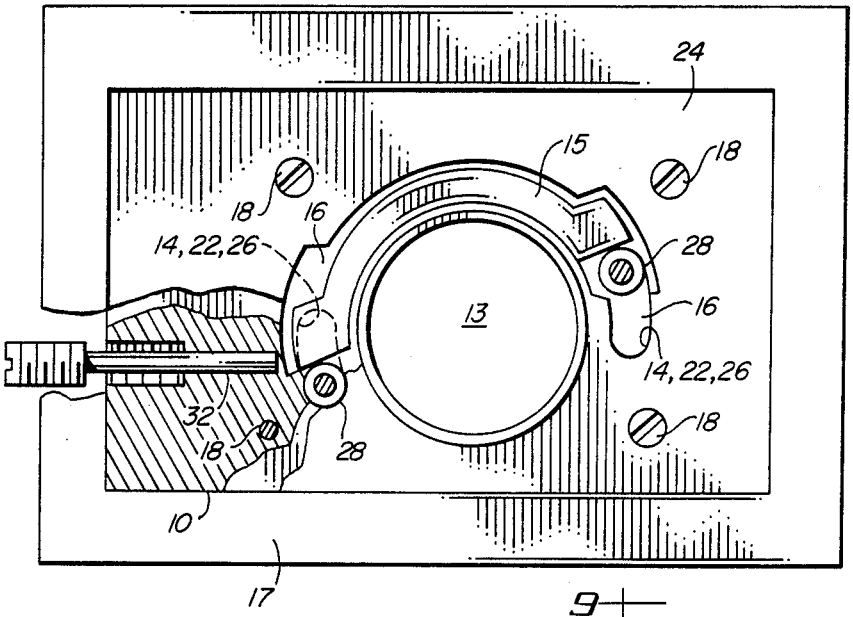
FIG. 7 illustrates the manner in which the latch pins of the interior rosette are coupled together when first emplaced within the slide latching recess means of the lock body.
Figure 8:
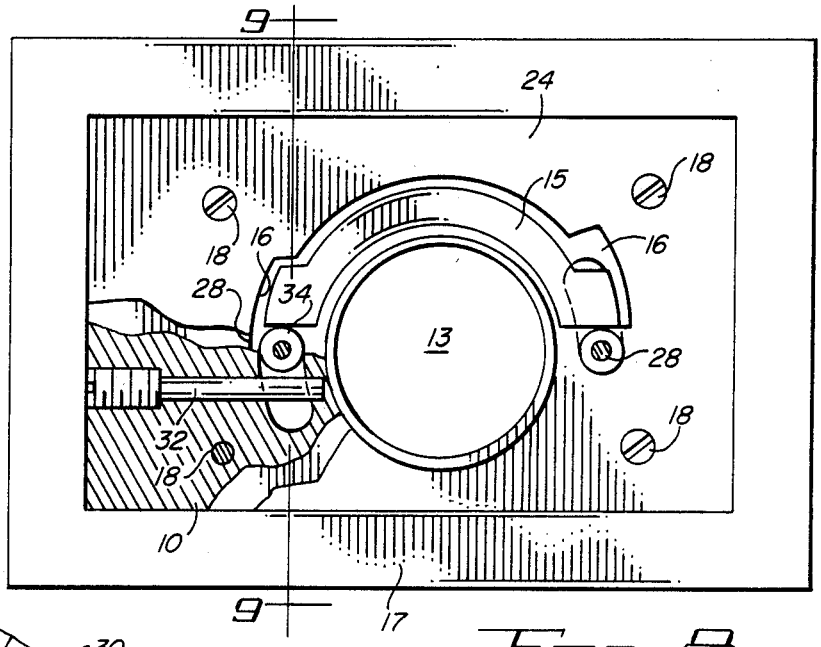
FIG. 8 illustrates the position of the latch pins of the second rosette after that rosette has been rotated sufficiently to lockingly engage the latch pins within the latching recesses and further illustrates the emplacement of the locking pin which provides an interference lock for inhibiting the disengagement of the latch pins from the latching recesses.

The drawings of FIGS. 7 and 8 have been reduced to the minimal detail to enable an understanding of the invention and thus the rosette 30 to which latch pins 28 are attached is not illustrated. In FIG. 7, the latch pins 28, coupled to rosette 30, not shown, have been inserted within latching recesses 22 and 26 and extend into the clearance recess 14 of the lock body 10. Slide coupler 15, emplaced within slide recess 16 of lock body 10, makes coupling contact with each of latch pins 28. In the illustration of FIG. 7, latch pins 28 are not in locking engagement with recesses 22 and 26.

In FIG. 8, latch pins 28 have been drawn into locking engagement with recesses 22 and 26 by rotating rosette 30, not shown, in a clockwise manner so as to cause each of latch pins 28 to be brought into locking engagement with the tapered ends of recesses 22 and 26. As is noted in FIG. 8, slide coupler 15, still couplingly engaged with each of latch pins 28, has slid along the arc of slide coupler recess 16 in response to the movement of latch pins 28 into locking engagement with the tapered ends of recesses 22 and 26.

Locking pin 32, shown drawn to the left in FIG. 7, is threadedly coupled into the body 10 of the lock so as to be drawn toward the right entering the left hand clearance recess 14 of lock body 10 in a manner so as to interfere with the disengagement of the left hand latch pin 28 from the left hand tapered recesses 22 and 26.

Under the conditions shown in FIG. 8, if an attempt is made to rotate rosette 30, not shown, in a counterclockwise direction so as to draw latch pins 28 out of locking engagement with tapered recesses 22 and 26, locking pin 32 will prevent the disengaging movement of the left hand latch pin 28 from its tapered recesses 22 and 26, while slide coupler 15, which couples latch pins 28 one to the other, prevents the right hand latch pin 28 from rotating about the left hand latch pin 28 and thus being slidingly disengaged from its tapered latching recesses 22 and 26, to the right of the illustration.

Figure 9:
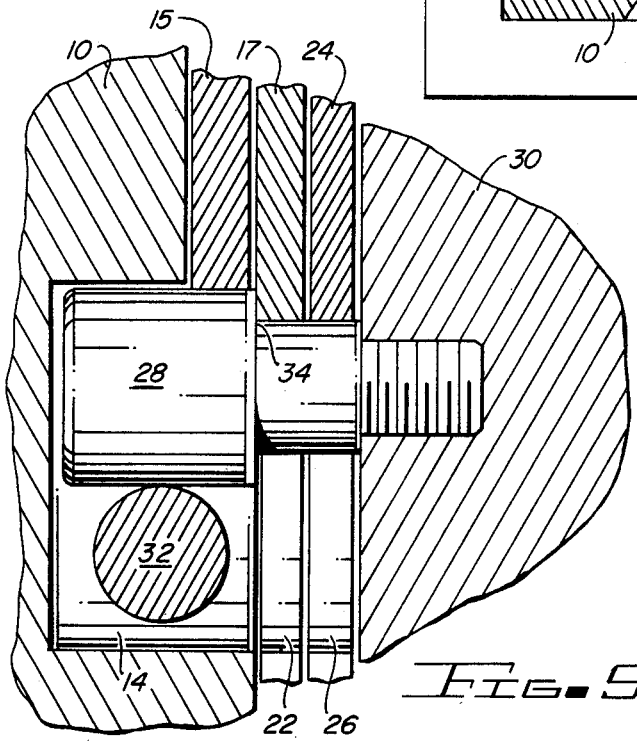
FIG. 9 is a cross-sectional view taken along the lines 9—9 of FIG. 8 illustrating the mechanical engagement of the latch pins within the latching recesses and the interference locking of the assembly.

The interfering locking relationship of the parts is shown in the cross-sectional view taken across line 9—9 of FIG. 8 and shown in FIG. 9. Here, the left hand latch pin 28 is threadedly engaged within the rosette 30. The left hand latch pin 28 has been passed through tapered recesses 26 and 22 of cover plate 24 and door protection plate 17, respectively. Rosette 30 has then been rotated in a clockwise direction which raises latch pin 28 from the lower regions of recesses 26 and 22 to the upper, tapered regions where a locking engagement between of the recesses 26 and 22 and latch pin 28 occurs.

Slide coupler 15, in contact with the left hand latch pin 28, accomplishes a rigid mechanical coupling between the left hand latch pin 28 and the right hand latch pin 28. The locking engagement of latch pin 28 with the walls of recesses 22 and 26 and with plates 17 and 24 is shown at reference 34 of FIG. 9.

When lock pin 32 is driven into clearance recess 14 within lock body 10, it engages in an interfering relationship with latch pin 28 preventing latch pin 28 from being lowered, by counterclockwise rotation of rosette 30, so as to eliminate the interference 34 and permit the subsequent removal of latch pin 28 from recesses 22 and 26.

Since locking pin 32 may only be withdrawn from interfering relationship with the left hand latch pin 28 when the door in which lock body 10 is mounted has been emplaced in an open position, the coupling of rosette 30 to lock body 10 has been achieved in a highly secure manner. Since rosette 43 cannot be removed until rosette 30 is removed and deadbolt throw/retract mechanism 37 is positioned to the mid point of travel of deadbolt 11, the present invention offers highly improved, anti-intrusion characteristics to the lock body on which it is provided as an improvement, all the coupling elements being totally concealed and inaccessible when the door to which the lock is mounted is closed.

What has been disclosed is a deadbolt lock adaptable for installation in doors of various thicknesses. The lock body and interior rosette are established at a fixed position with respect to the interior surface of the door in which the lock is mounted. A cylindrical threaded coupler is threaded to an extension of the exterior keyway-carrying rosette of the lock and the coupling between the threaded cylinder and the threaded extension of the rosette are adjusted in accordance with the thickness of the door to which the lock is installed. The interior threaded coupling cylinder is then inserted within the bore of the lock, the mounting being achieved without interference with the deadbolt throw/retract mechanism interior of the lock body. The assembly is secured by compressing the door between interior and exterior decorative plates, the compression resulting by the drawing of the exterior rosette against the outer decorative plates by engaging a retaining nut with threads of the interior coupling cylinder which protrudes through the interior side of the lock body. Both the exterior and interior keyway-carrying rosettes are fastened by means of concealed non-rotatable couplings. The door must be in its opened position before any access may be gained to the interior of the lock. An extremely strong lock mounting arrangement results which inhibits tampering with the lock when the door is closed.

Those skilled in the art will conceive of other embodiments of the invention which may be drawn from the teachings herein. To the extent that such other embodiments are so drawn, it is intended that they shall fall within the ambit of protection of the claims appended hereto.

Having described my invention in the foregoing specification and the accompanying drawings in such a clear and concise manner that those skilled in the art will easily understand and readily practice the invention, that which I claim is:

1. An improved lock comprising:

a lock body having therein a keyway and lock mechanism bore and a recessed annular segment diametrically displaced beyond a portion of the outer periphery of keyway and lock mechanism bore;

first and second slide latch recess means coupled to said lock body, one of each intercepting the extremes of said recessed annular segment;

raised element means for further defining said keyway and lock mechanism bore and providing secure access thereto;

first and second latch pins coupled to said raised element means said first latch pin being further lockingly engaged in said first slide latch recess means and said second latch pin being further lockingly engaged in said second slide latch recess means;

an annular segment slidingly coupled to said recessed annular segment in said lock body for coupling said first latch pin to said second latch pin for inhibiting rotation of said second latch pin about said first latch pin; and latch pin locking means for inhibiting the disengagement of said first latch pin from said first slide latch recess means and, in cooperation with said annular segment, for inhibiting the disengagement of said second latch pin from said second slide latch recess means.

2. In combination with a deadbolt lock for mounting in a door said lock having a lock body with a bore therethrough providing access to the deadbolt throw/-retract mechanism a first raised element means non-adjustably coupled to said lock body carrying a keyway for providing secure access to said deadbolt throw/retract mechanism and a second raised element keyway-carrying means coupled to said lock body the improvement for making the deadbolt lock adaptable for mounting in doors of various thicknesses comprising:

coupling means non-adjustably non-rotatingly mounted within said bore and extending a first preselected distance beyond a first outer boundary of said bore;

means for adjustably coupling said second raised element keyway-carrying means to said coupling means a second preselected distance beyond said first outer boundary said adjustable coupling means being inaccessible when said deadbolt lock is mounted in a door and the door is in its closed position;

wherein said coupling means non-adjustably mounted within said bore comprises cylindrical means screw threaded for coupling to said adjustable coupling means, said adjustable coupling means comprises a cylindrical extension of said second raised element keyway-carrying means screw threaded for adjustably mating with the screw threads of said coupling means, said cylindrical screw threaded coupling means non-adjustably mounted within said bore further comprises means for mounting said coupling means within said bore without interference with said deadbolt throw/retract mechanism, said means for mounting said coupling means within said bore further comprises means for so mounting said coupling means within said bore only when said deadbolt throw/retract mechanism is in a preselected position, said cylindrical screw threaded coupling means non-adjustably mounted within said bore further comprises means for permitting the free operation of said deadbolt throw/-retract mechanism while said coupling means is so mounted within said bore, said second raised element keyway-carrying means further comprises means for inhibiting rotation thereof for inhibiting adjustment of the threaded coupling to said non-adjustably mounted coupling means, said means for inhibiting rotation being concealed when said deadbolt lock is mounted to a door;

cover plate means interposed between said second raised element keyway-carrying means and said lock body and coupled to each, wherein said second raised element keyway-carrying means further comprises means for concealed non-rotatable coupling to said cover plate means;

slide latching recess means coupled to said lock body, wherein said first raised element keyway-carrying means further comprises latch pin means affixed thereto for concealed locking engagement to said slide latching recess means upon preselected movement of said first raised element keyway-carrying means;

means for inhibiting disengagement of a first one of said latch pin means from a first one of said slide latching recess means;

means, coupling a second one of said latch pin means to said first one of said latch pin means for inhibiting rotation of said second one about said first one of said latch pin means for inhibiting disengagement of said second one of said latch pin means from a second one of said slide latching means, wherein the means for inhibiting disengagement of a first one of said latch pin means from a first one of said slide latching recess means comprises means for inhibiting translation of said first one of said latch pin means within said first one of said slide latching recess means, said means coupling a second one of said latch pin means to said first one of said latch pin means comprises an annular segment further slidingly coupled to said lock body.

3. The improvement of claim 2 wherein said means for inhibiting translation of said first one of said latch pin means within said first one of said slide latching recess means comprises means coupled to said first one of said slide latching recess means for blocking the recess of said slide latching recess means and inhibiting slide motion of said latch pin means therein.

* * * * *